United States Patent [19]

Nishikawa

[11] 4,248,518

[45] Feb. 3, 1981

[54] ELECTROPHOTOGRAPHIC COPYING APPARATUS

[75] Inventor: Masaji Nishikawa, Hachioji, Japan

[73] Assignee: Olympus Optical Company Limited, Tokyo, Japan

[21] Appl. No.: 899,416

[22] Filed: Apr. 24, 1978

[30] Foreign Application Priority Data

Apr. 27, 1977 [JP] Japan ..... 52-47817

[51] Int. Cl.[3] ..... G03G 15/00

[52] U.S. Cl. ..... 355/3 CH; 355/14 CH; 430/35; 430/902

[58] Field of Search ..... 355/3 R, 3 CH, 3 TE, 355/14 CH; 96/1 C; 430/35, 100, 902

[56] References Cited

U.S. PATENT DOCUMENTS

| | | | |
|---|---|---|---|
| 2,817,765 | 12/1957 | Hayford et al. | 430/902 X |
| 2,934,649 | 4/1960 | Walkup | 355/3 CH X |
| 3,609,031 | 9/1971 | Kinoshita | 355/3 R X |
| 3,615,395 | 10/1971 | Yamaji et al. | 355/3 R X |
| 3,794,418 | 2/1974 | Makino et al. | 355/3 R |
| 3,967,891 | 7/1976 | Rippstein | 96/1 C X |
| 3,977,778 | 8/1976 | Seko et al. | 355/3 R |
| 3,997,259 | 12/1976 | Bhagat | 96/1 C X |

*Primary Examiner*—Fred L. Braun

*Attorney, Agent, or Firm*—Haseltine and Lake

[57] ABSTRACT

An electrographic apparatus for selectively producing, on a latent image holding member including a first electrostatic latent image produced thereon by a first charge, a second electrostatic latent image composed of a second charge which is negative with respect to the first electrostatic latent image and which is opposite in polarity to the first electrostatic latent image. The apparatus includes a device for selectively applying to the latent image holding member a second charge which is opposite in polarity to the first charge.

2 Claims, 9 Drawing Figures

ELECTROPHOTOGRAPHIC COPYING APPARATUS

BACKGROUND OF THE INVENTION

1. Field of the Invention

This invention relates to an electrographic process and apparatus by which it is carried out.

2. Description of the Prior Art

In general, a process of converting a negative picture image into a positive picture image is realized by a reversal development process or a special electrographic process which makes use of a photosensitive plate composed of a photosensitive layer and an insulating layer coated thereon and in which a corona charge polarity at each charging step of producing on the insulating layer an electrostatic latent image is suitably selected. Another well known process is realized by using an electrographic photosensitive screen and by suitably selecting at each electrographic step a corona charge polarity and a bias voltage.

However, a reversal developing process of converting a latent image which is positive with respect to an optical image into a negative picture image has to adhere a toner to that part of a record medium which is not subjected to an electrostatic attractive force. As a result, there is a risk of an edge effect being induced, so that it is difficult to obtain a good picture image. Particularly, a sufficiently satisfactory reversal developing technique which makes use of one ingredient magnetic toner has not yet been developed and is not yet ready for use in practice.

The above mentioned electrographic process which makes use of the photosensitive plate and in which the corona charge polarity is suitably selected or the above mentioned electrographic process which makes use of the photosensitive screen and in which the bias voltage is suitably selected can obtain a good picture image, but the apparatus by which it is carried out is expensive, large in size and complex in construction. As a result, such electrographic process is not suitable for use in a microfilm printer or the like.

SUMMARY OF THE INVENTION

An object of the invention, therefore, is to provide an electrographic process and apparatus by which it is carried out, which can eliminate the above mentioned drawbacks which have been encountered with the prior art techniques, that is, which can obtain a positive copy of a picture image from a negative picture image in a simple manner and which can obtain a reversed picture image with the aid of one ingredient magnetic toner of a non-polarized developing agent.

Another object of the invention is to provide an electrographic process and apparatus by which it is carried out, which can selectively obtain a negative picture image or a positive picture image by means of one and same apparatus in a simple manner.

A further object of the invention is to provide an electrographic apparatus which is so constructed and arranged that a negative picture image or a positive picture image can selectively be obtained with the aid of one ingredient magnetic toner or a non-polarized developing agent.

A feature of the invention is the provision of an electrographic process comprising producing, on a latent image holding member, a first electrostatic latent image with the aid of a first charge having one polarity, and selectively applying to said latent image holding member a second charge having a polarity which is opposite to said polarity of said first charge, whereby on said latent image holding member is produced a second electrostatic latent image composed of said second charge which is negative to said first electrostatic latent image and opposite in polarity thereto.

Another feature of the invention is the provision of an electrographic apparatus comprising a latent image holding member, means for producing, on said latent image holding member, an electrostatic latent image, a chargeable member composed of an electrically conductive member and a dielectric layer coated thereon, means for uniformly charging said chargeable member, and means for bringing said chargeable member uniformly charged into contact with and separating from said latent image holding member including said electrostatic latent image produced thereon.

Other objects, features and advantages of the present invention will become apparent upon a perusal of the following specification taken in connection with the accompanying drawings, wherein:

DETAILED DESCRIPTION OF THE PREFERRED EMBODIMENTS

Figure 1A:
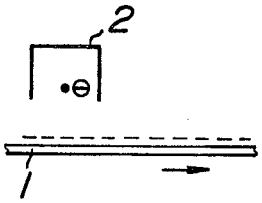
FIGS. 1A, 1B and 1C are schematic sectional views for explaining the principle of an electrographic process according to the invention.
Figure 1B:
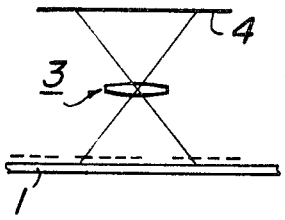
Figure 1C:
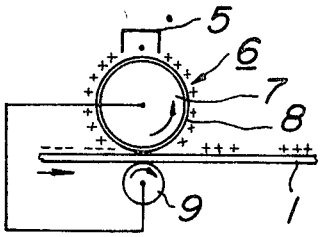

FIGS. 1A, 1B and 1C show schematic sectional views for illustrating the principle of an electrographic process according to the invention. FIG. 1A shows one example of an uniformly charging step in which a photosensitive body 1 is uniformly charged with a negative polarity by means of a corona discharge device 2.

FIG. 1B shows one example of an optical image illuminating step in which the uniformly charged photosensitive body or charge holding member 1 is illuminated through an optical system 3 with an optical image corresponding to a manuscript 4 to be recorded to produce on the photosensitive body 1 an electrostatic latent image corresponding to the optical image.

FIG. 1C shows one example of a charge transferring step in which a chargeable drum 6, which has uniformly been charged by means of a corona discharge device 5 with a polarity which is opposite to that of the uniformly charging step in FIG. 1A, is brought into contact with the photosensitive body 1 holding the electrostatic latent image produced thereon to transfer the charge of the electrostatic latent image produced on the photosensitive body 1.

In the present example shown in FIG. 1C, the chargeable drum 6 is composed of a metallic drum 7 and a dielectric layer 8 coated around the outer periphery of the metallic drum 7. In contact with or adjacent to the dielectric layer 8 is arranged an electrically conductive roller 9 which is held at a potential which is the same as that of the metallic drum 7. The photosensitive body 1 passes between the chargeable drum 6 and the electrically conductive roller 9.

In FIG. 1, an imagewise dark area of the photosensitive body 1 is held at substantially the charge potential produced by the uniformly charging step shown in FIG. 1A. As a result, if chargeable drum 6 is brought into contact with the photosensitive body 1 as shown in FIG. 1C, a strong electric field is produced between the imagewise dark area of the photosensitive body 1 and the chargeable drum 6 to transfer the charge according to Paschen's law. The charge remains on the chargeable drum 6 even at a time after the transfer of charge has been completed. The potential of the charge to be charged beforehand on the chargeable drum 6 and the amount of charge are selected such that the amount of electric charge being transferred is substantially sufficient to eliminate the charge at the imagewise dark area of the photosensitive body 1.

In the imagewise exposed area of the photosensitive body 1 where the charge is eliminated by the optical image illuminated thereon, the charge transferred from the chargeable drum 6 becomes the picture image charge of the imagewise exposed area of the photosensitive body 1. As a result, the more the amount of charge being transferred the higher the concentration of the picture image being obtained.

As described above, the amount of charge to be transferred from the chargeable drum 6 is defined in relation to a reference amount which can substantially eliminate the charge on the imagewise dark area of the photosensitive body 1. But, the condition that the polarity of the charge on the imagewise dark area of the photosensitive body 1 is opposite to that of the charge on the chargeable drum 6 causes the charge to easily transfer.

On the contrary, the potential of the imagewise exposed area of the photosensitive body 1 is substantially zero, so that the potential difference between the imagewise exposed area of the photosensitive body 1 and the chargeable drum 6 is small. This is a condition under which the charge is difficult to be transferred. Such condition is objectionable to the object of the invention. In order to obviate such objection, it is preferable to make the dielectric layer 8 of the chargeable drum 6 large in thickness for the purpose of obtaining a high potential from the same amount of charge applied to the chargeable drum 6. This will be described with reference to following calculating examples.

In the following calculating examples, let it be assumed that, as the photosensitive body 1 is moved, the gap between the photosensitive body 1 and the chargeable drum 6 is gradually decreased up to a minimum value and then gradually increased and that a voltage for starting discharge between the photosensitive body 1 and the charged drum 6 is 600 V and a voltage for stopping discharge therebetween is 300 V.

Calculating Example 1

A photosensitive body 1 having a thickness t and a dielectric constant $\epsilon$ was uniformly charged and illuminated with an optical image to produce thereon an electrostatic latent image whose surface potential at its imagewise dark area $V_D$ is $-300$ V and at an imagewise exposed area $V_L$ is $-20$ V.

A chargeable drum 6 including a dielectric layer 8 having a thickness of t and a dielectric constant of $\epsilon$ was uniformly charged with a voltage $V_C$ of $+600$ V. The chargeable drum 6 was rotated in contact with the photosensitive body 1 to transfer the charge on the chargeable drum 6 onto the photosensitive body 1. A potential difference $V_I$ between the chargeable drum 6 and the imagewise dark area of the photosensitive body 1 before starting the discharge therebetween is given by $$V_I = V_C - V_D = 600\text{ V} - (-300\text{ V}) = 900\text{ V}.$$

This potential difference $V_I$ exceeds the discharge starting voltage so that the discharge occurs.

Let the potential charge photosensitive body 1 at which the photosensitive body 1 arrives at a voltage $V_E$ of terminating the discharge be $V_D'$ and let that voltage of the chargeable drum 6 at which the chargeable drum 6 arrives at the voltage $V_E$ of terminating the discharge be $V_C'$, then $$V_E = V_C' - V_D' = 300\text{ V}.$$

If the thickness t and dielectric constant $\epsilon$ of the photosensitive body 1 are equal to those of the chargeable drum 6, the electrostatic capacity of the photosensitive body 1 becomes equal to that of the chargeable drum 6. As a result, the potential charge v of the photosensitive body 1 due to the charge received may be considered to be the same as the potential charge v of the chargeable drum 6 due to the charge transferred and hence $$V_C' = V_C - v \text{ and } V_D' = V_D + v$$

Thus, $$V_E = (V_C - v) - (V_D + v) = (V_C - V_D) - 2v = 900\ V - 2v = 300\ V.$$

Accordingly, $v = 300\ V$

Hence, $$V_D' = V_{D+v} = -300V + 300V = 0V$$

$$V_C' = V_{C-v} = 600V - 300V = 300V$$

That is, the charge of the photosensitive body 1 is completely eliminated at its imagewise dark area and the charge of $+300$ V remains on the chargeable drum 6.

Similar calculation on the imagewise exposed area of the photosensitive body 1 gives $$V_I = V_C - V_L = 600V - (-20\text{ V}) = 620\text{ V}.$$

The above $V_I$ exceeds the discharge starting voltage, so that the transfer of electric charge is started.

Let the surface potential of the imagewise exposed area of the photosensitive body 1 when the discharge is terminated be $V_L'$, then $$V_E = V_C' - V_L' = 300V.$$

Let the potential charge of the photosensitive body 1 and the chargeable drum 6 caused by the transferred charge be v', then $$V_L' = V_L + v'$$

$$V_C' = V_C - v'$$

Accordingly, $$V_E = (V_C - v') - (V_L + v') = (V_C - V_L) - 2v' = 620\ V - 2v' = 300\ V$$

That is, $v' = 160V$.
Hence, $$V_L' = V_L + v' = -20V + 160V = 140V$$

$$V_C' = V_C - v' = 600V - 160V = 440V$$

That is, the charge of +140 V remains at the imagewise exposed area of the photosensitive body 1 and the charge of +440 V remains on the chargeable drum 6.

Judging from all of the above mentioned results, it follows that the charge transferred from the chargeable drum 6 to the photosensitive body 1 causes the electrostatic latent image produced on the photosensitive body 1 and having the surface potential of −300 V at the imagewise dark area and −20 V at the imagewise exposed area to change into an electrostatic latent image produced by the positive charge which is negative with respect to the optical image and having the surface potential of 0 V at the imagewise dark area and +140 V at the imagewise exposed area.

Calculating Example 2

A photosensitive body 1 having a thickness t and a dielectric constant $\epsilon$ was uniformly charged and illuminated with an optical image to produce thereon an electrostatic latent image whose surface potential at its imagewise dark area $V_D$ is −300 V and at its imagewise exposed area $V_L$ is −20 V.

A chargeable drum 6 including a dielectric layer 8 coated thereon and having a thickness of 2 t and a dielectric constant of $\epsilon$ was uniformly charged with a voltage $V_C$ of +900 V. The chargeable drum 6 was rotated in contact with the photosensitive body 1 to transfer the charge on the chargeable drum 6 onto the photosensitive body 1.

A potential difference $V_I$ between the charged drum 6 and the imagewise dark area of the photosensitive body 1 before the starting the discharge therebetween is given by $$V_I = V_C - V_D = 900V - (-300V) = 1{,}200V$$

This potential difference $V_I$ exceeds the discharge starting voltage so that the discharge occurs.

Let the potential change of the photosensitive body 1 due to the charge received be v, then the potential change of the chargeable drum 6 becomes 2v, since the thickness of the dielectric layer 8 thereof is two times larger than that of the photosensitive body 1 and the electrostatic capacity of the dielectric layer 8 becomes one half smaller than that of the photosensitive body 1.

As a result, the surface potential $V_D'$ at the imagewise dark area of the photosensitive body 1 and the surface potential $V_C'$ of the chargeable drum 6 are given by $$V_D' = V_D + v \text{ and } V_C' = V_C - 2v.$$

Hence, the voltage $V_E$ of terminating the discharge is given by $$V_E = V_C' - V_D' = (V_C - 2v) - (V_D + v) = (V_C - V_D) - 3v = 1{,}200\ V - 3v = 300\ V.$$

Thus, $$3v = 900V, \text{ that is, } v = 300V.$$

As a result, $$V_D' = V_D + v = -300V + 300V = 0V$$

$$V_C' = V_C - 2v = 900V - 600V = 300V.$$

This result is the same as that of the calculating example 1.

That is, the amount of charge at the imagewise dark area of the photosensitive body 1 becomes zero and the charge of +300 V remains on the chargeable drum 6.

The potential difference $V_I$ at the imagewise exposed area of the photosensitive body 1 before the starting of discharge is given by $$V_I = V_C - V_L = 900V - (-20V) = 920V.$$

This potential difference $V_I$ exceeds the discharge starting voltage, so that the discharge is started to transfer the electric charge from the chargeable drum 6 to the photosensitive body 1.

Let the potential change of the photosensitive body 1 caused by the transferred charge up to the end of the discharge be v', then the potential change of the chargeable drum 6 becomes 2v'. Since, $$V_L' = V_L + v' \text{ and}$$

$$V_C' = V_C - 2v',$$

the discharge terminating voltage $V_E$ is given by $$V_E = V_C' - V_L' = (V_C - 2v' - (V_L + v') = (V_C - V_L) - 3v' = 920\ V - 3v' = 300\ V$$

Thus, $$3v' = 620V, \text{ that is,}$$

$$v' \doteqdot 207V$$

As a result, $$V_L' = V_L + v' = -20V + 207V = 187V$$

$$V_C' = V_C - 2v' = 900V - 414V = 486V.$$

Juding from all of the above mentioned results, it follows that the charge on the imagewise dark area of the photosensitive body 1 is zero and that an electrostatic latent image having a surface potential of +187 V is produced on the imagewise exposed area of the photosensitive body 1 by means of a positive electric charge which is negative with respect to the optical image.

The calculations described in the above mentioned two calculating examples are effected on the basis of a hypothesis, so that the result thus calculated is more or less different from a phenomenon which occurs in practice. But, it is understandable from the above mentioned two calculating examples that if the electrostatic capacity of the chargeable drum 6 is made small so as to make the surface potential thereof high, the potential of the electrostatic latent image on the photosensitive body 1 after the electric charge has been transferred from the chargeable drum 6 onto the photosensitive body 1 becomes high.

The chargeable drum 6 will now be described. The chargeable drum 6 is composed of the metallic drum 7 and the dielectric layer 8 coated around the outer periphery of the metallic drum 7 and hence is simple in construction. As described above, it is necessary to define the electrostatic capacity and charge potential, but any other required matters are not important to the present invention. The dielectric layer 8 may be composed of an inorganic thin film formed of glass, ceramics or the like or composed of various kinds of plastic films, etc. The dielectric layer 8 may be coated on the metallic drum 7 by dipping the metallic drum 7 into a solution or melted liquid of a raw material, by painting the solution or melted liquid of the raw material through a roller on the metallic drum 7, by extruding the solution or melted liquid of the raw material through a slit onto the metallic drum 7, by spraying the solution or melted liquid of the raw material onto the metallic drum 7, by uniformly adhering material powders and then melting these material powders, by polymerizing synthetic resin in vapor phase, by vapor depositing inorganic material on the metallic drum 7 and by cementing a film-shaped layer onto the metallic drum 7 or the like. It is preferable that the dielectric layer 8 thus formed is uniform in thickness, does not include pin holes or the like, has a smooth surface, can receive a high potential, is difficult to induce a cut failure, and has a property for preventing a breakdown due to electric charge.

The chargeable drum 6 may uniformly be charged by means of a conventional corona discharge device 5 as shown in FIG. 1C. If the chargeable drum 6 is positively charged with a corona source of ions, it is possible to charge the chargeable drum 6 in a more uniform manner.

In order to make the surface potential produced on the chargeable drum 6 constant when it is charged with the corona source of ions, it is preferable to arrange a grid 10 between the corona discharge device 5 and the chargeable drum 6 and to connect a bias voltage source 11 between the grid 10 and the metallic drum 7 such that a bias voltage, which is substantially equal to that potential which is to be applied to the chargeable drum 6, is applied to the grid 10.

Figure 2B:
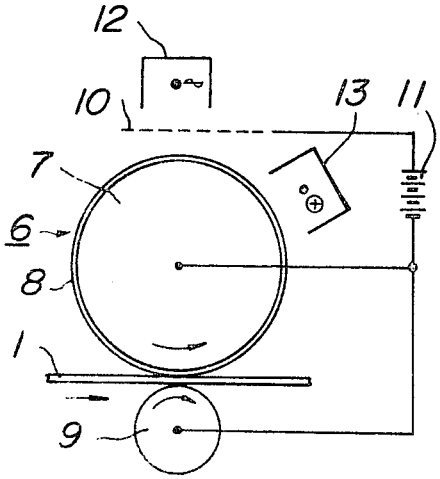
Figure 3A:
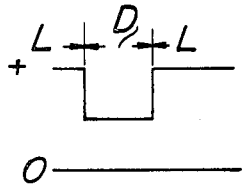
FIGS. 3A, 3B and 3C are graphs for illustrating the surface potential condition of the chargeable drum shown in FIGS. 2A and 2B.
Figure 3B:
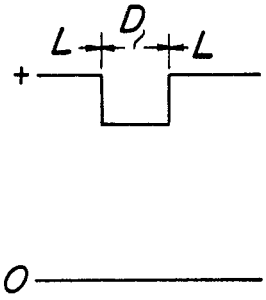
Figure 3C:
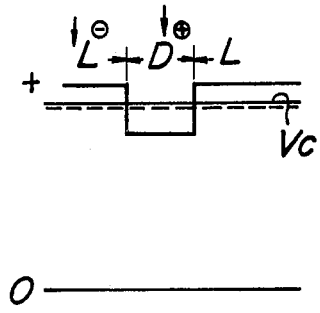

As seen from the above described calculating examples 1 and 2, the surface potential at the imagewise exposed area L of the chargeable drum 6 after the charge thereon has been transferred onto the photosensitive body 1 is different in value from that at the imagewise dark area D of the photosensitive body 1 as shown in FIG. 3A. As a result, even if the chargeable drum 6 is charged again with the corona source of ions, the surface potential thereof at the imagewise exposed area L of the photosensitive body 1 is also different in value from that at the imagewise dark area D thereof as shown in FIG. 3B. In this case, as shown in FIG. 2B, provision is made of an alternating current corona discharge device 12 opposed through the grid 10 to the chargeable drum 6 and provision is also made of a direct current corona discharge device 13 located at a position on this side of the alternating current corona discharge device 12 viewed in the rotating direction of the chargeable drum 6 and opposed to the chargeable drum 6. The direct current corona discharge device 13 functions to charge the chargeable drum 6 such that the potential at its imagewise exposed area L is higher than the potential $V_C$ produced by its uniform charge and shown by a full line in FIG. 3C and that the potential at its imagewise dark area D is lower than the potential $V_C$. Then, the alternating current corona discharge device 12 functions to charge the chargeable drum 6 through the grid 10 having a potential which is substantially equal to the potential $V_C$ such that the part of the chargeable drum 6 which corresponds to the imagewise exposed area L whose potential is higher than the potential $V_C$ is charged with a negative half cycle of the alternating current corona discharge device 12 and that the part of the chargeable drum 6 which corresponds to the imagewise dark area D whose potential is lower than the potential $V_C$ is charged with a positive half cycle of the alternating corona discharge device 12, whereby the chargeable drum 6 can uniformly be charged with a potential shown by dotted lines in FIG. 3C and substantially equal to the potential $V_C$ shown by the full line.

If the potential of the chargeable drum 6 is not uniform, the amount of charge to be transferred therefrom to the photosensitive body 1 made in contact therewith becomes nonuniform and hence there is a risk of the electrostatic latent image produced on the photosensitive body 1 being non-uniform.

In addition, in order to effectively transfer the charge on the chargeable drum 6 onto the photosensitive body 1, it is necessary to make the metallic drum 7 and the back surface of the photosensitive body 1 electrically conductive and to maintain them at the same potential.

Figure 2A:
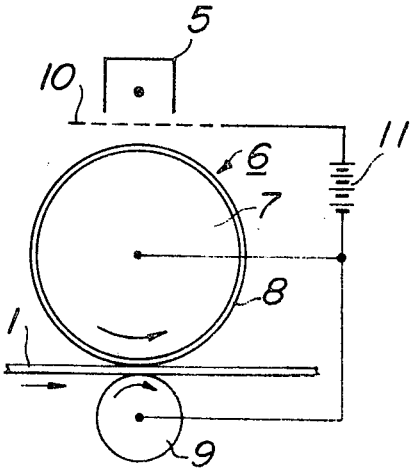
FIGS. 2A and 2B are schematic sectional views for showing two examples of charge transferring step of an electrographic process according to the invention.

In the electrographic apparatus shown in FIGS. 1C, 2A and 2B, the photosensitive body 1 passes between the chargeable drum 6 and the electrically conductive roller 9, so that it is quite convenient to use a photosensitive body 1 formed on paper or film-shaped substrate. In this case, between the back surface of the photosensitive body 1, that is, the electrically conductive roller 9 and the chargeable drum 6 is connected an adjustable bias voltage source (not shown) so as to adjust the amount of charge to be transferred from the chargeable drum 6 to the photosensitive body 1 by adjusting the voltage value of the bias voltage source in substantially similar manner to a device for adjusting the amount of exposure for use in a conventional electrographic apparatus. As a result, the above mentioned device for adjusting the bias voltage may be used in place of the device for adjusting the amount of exposure for use in a microfilm printer whose amount of adjusting the exposure is not large.

The electrostatic latent image produced on the photosensitive body 1 and negative to the optical image may be developed into a visible image by a well known developing process. In this case, the positive electrostatic latent image is not reversely converted into a negative picture image by the developing process.

On the contrary, in the electrographic process according to the invention, use is made of a novel step of producing a negative electrostatic latent image and of developing it into a visible image by means of a normal developing process. As a result, it is possible to obtain a very good negative picture image without being influenced by any edge effect. At present, it is difficult to practically effect a reversal developing process which makes use of non-polarizing one ingredient magnetic toner, so that the electrographic process according to the invention contributes greatly in electrographic industry.

An electrographic apparatus for carrying out the above mentioned electrographic process according to the invention may be constructed such that the same apparatus can selectively produce the negative picture image or the positive picture image. As a result, the electrographic apparatus according to the invention is very suitable for a microfilm printing apparatus. That is, the electrographic apparatus according to the invention is capable of freely selecting the negative picture image or the positive picture image with the aid of an extremely simple developing process of using only non-polarized toner.

For example, the photosensitive body 1 may be composed of a zinc oxide coated photosensitive paper. The zinc oxide coated photosensitive paper may be uniformly charged and uniformly illuminated with an optical image to produce thereon an electrostatic latent image which is positive to the optical image. Then, the positive electrostatic latent image is developed by means of non-polarized one ingredient magnetic toner to obtain a positive picture image. Alternatively, the positive electrostatic latent image produced on the zinc oxide coated photosensitive paper may be transferred with the opposite polarity charge from the chargeable drum 6 to the photosensitive body 1 and then developed by the non-polarized one ingredient magnetic toner to obtain a negative picture image.

In the case of obtaining the positive picture image by the same electrographic apparatus which can selectively obtain the negative picture image or the positive picture image, it is sufficient to make the step of transferring the opposite polarity charge from the chargeable drum onto the photosensitive body inoperative. Such inoperative operation may simply be effected by an electrical means for changing an electrical connection or by mechanical means to be described later.

The photosensitive body to be used for the electrographic process according to the invention is required not only to be charged with both positive and negative polarities but also to be photosensitive when the photosensitive body is charged with at least one polarity. Such photosensitive body is not of specially prepared one, but may be composed of a photosensitive body used in general or may be composed of a more or less modified photosensitive body. For example, a zinc oxide coated photosensitive paper is usually charged with a negative polarity and has a high sensitivity for the negative polarity charge, but is difficult to be charged with a positive polarity and has a low sensitivity for the positive polarity charge.

But, a zinc oxide photosensitive paper effectively chargeable with both positive and negative polarities and having a similar photosensitivity for both polarity charges, has been used in practice. Such kind of photosensitive paper may effectively be used for the present invention. The photosensitive body used for the present invention is not required to be photosensitive for one of the polarities, so that a photosensitive body for satisfying such condition can be realized in an extremely easy manner. For example, Se-polyvinylcarbazole (PVK) compound photosensitive body is photosensitive when it is charged with a negative polarity, but does not exhibit a photosensitivity when it is charged with a positive polarity and the charge is held thereon under good condition. As a result, the Se-PVK compound photosensitive body may effectively be used for the present invention. An Se photosensitive body has a good charge holding property when it is charged with a positive polarity and a good sensitivity, but is inferior in a charge holding property and photosensitive when it is charged with a negative polarity. The negative polarity charge holding property of the Se photosensitive body may be improved by changing its barrier layer or by forming a surface barrier layer or by changing vapor depositing condition. Such improved photosensitive body may be applied to the present invention.

As described above, the electrographic process according to the invention is capable of effecting the transfer of charge from the chargeable drum onto the electrographic photosensitive body with respect to the electrostatic latent image produced on the electrographic photosensitive body. Alternatively, the invention is capable of effecting the transfer of charge in a similar manner with respect to an electrostatic latent image produced on a dielectric record paper having no sensitivity, whereby the positive picture image can be converted into the negative picture image or vice versa.

The method of producing on the dielectric record paper the electrostatic latent image may be effected by a transfer of electrostatic latent image process (T.E.S.I. process), a process of modulating a flow of corona ions by means of an electrostatic latent image produced on an electrographic photosensitive screen, a process of using a well known pin-shaped electrode for use in facsimile or printer, or by a process of using ion beams. As seen from the above, the electrographic process according to the invention may be applied to electrostatic latent images produced by any well known process.

Figure 4:
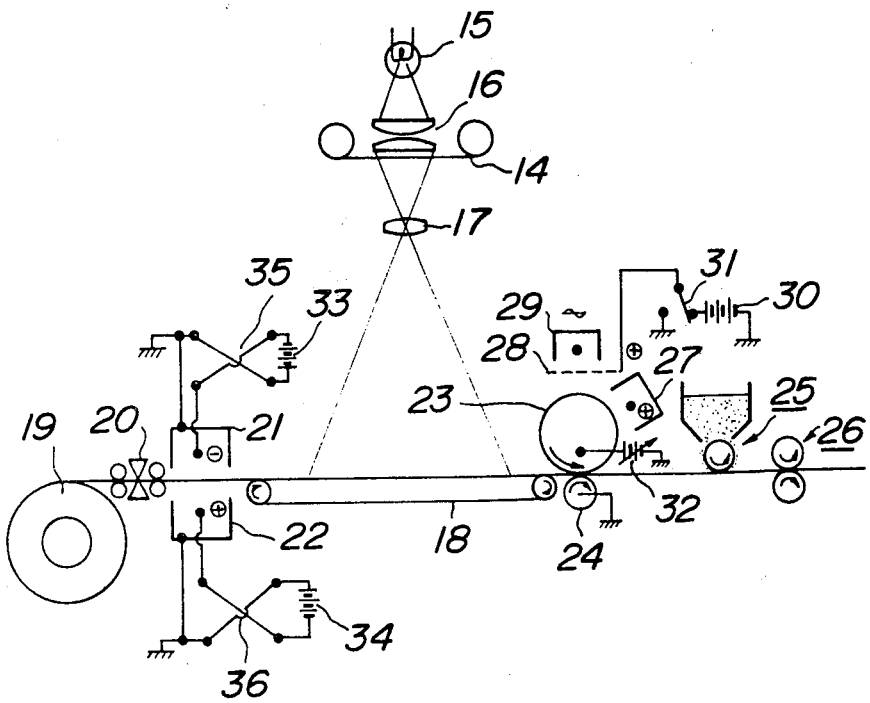
FIG. 4 is a schematic longitudinal sectional view of one embodiment of an electrographic apparatus according to the invention.

FIG. 4 shows an embodiment of an electrographic apparatus according to the invention. The present embodiment constitutes a microfilm printer. A picture image recorded on a microfilm 14 is exposed through an illumination lens 16 to a light source 15 and then is projected through a projection lens 17 onto a photosensitive record sheet 19 on a conveyor belt 18. In the present embodiment, the photosensitive record sheet 19 is composed of a roll-shaped zinc oxide coated photosensitive sheet. The photosensitive record sheet 19 is cut by a cutter 20 into a desired length and is charged with a source of corona ions having, for example, a negative polarity directed from a corona discharge device 21. The photosensitive record sheet 19 is then fed to an optical image illumination position by means of the conveyor belt 18.

In the present embodiment, provision is made of a corona discharge device 22 opposed through the photosensitive record sheet 19 to the corona discharge device 21. The corona discharge device 22 functions to charge the photosensitive record sheet 19 with a flow of corona ions having a polarity which is opposite to the polarity of a flow of corona ions directed from the corona discharge device 21. In the present embodiment, the corona discharge device 22 functions to charge the photosensitive record sheet 19 with a flow of corona ions having a polarity which is opposite to that of the flow of corona ions directed from the corona discharge device 21, that is, to charge the photosensitive record sheet 19 with a flow of corona ions having a positive polarity such that the charge having the negative polarity can easily and uniformly be held on the surface of the photosensitive record sheet 19.

On the photosensitive record sheet 19 illuminated with the optical image is produced an electrostatic latent image which is positive with respect to the optical image. Then, the photosensitive record sheet 19 passes between a chargeable drum 23 and a grounded roller 24. As a result, the above mentioned transfer of charge is effected to convert the positive electrostatic latent image into a negative electrostatic latent image. Then, the photosensitive record sheet 19 passes through a developing device 25 and a fixing device 26 to produce a final copy of the picture image.

The above mentioned chargeable drum 23 is the same in construction as the chargeable drum 6 shown in FIGS. 1C, 2A and 2B and functions to start its rotation at the same time or in the course of or prior to feeding of the roll-shaped photosensitive record sheet 19.

The surface of the chargeable drum 23 is required to be uniformly charged at a sufficiently high potential prior to contact with the photosensitive record sheet 19. For this purpose, in the present embodiment, provision is made of a corona discharge device 27 for directing a flow of corona ions in the same manner as the corona discharge device 13 shown in FIG. 2B. Further, provision is made of an alternating current corona discharge device 29 for directing a flow of alternating current corona ions through a grid 28 applied with a positive bias voltage toward the chargeable drum 23. The bias voltage is applied from a bias voltage source 30 through a change-over switch 31 to the grid 28, the change-over switch 31 including a grounded contact and a contact connected to the bias voltage source 30. The chargeable drum 6 shown in FIG. 2B is directly connected to ground, but in the present embodiment, the chargeable drum 23 is connected through a variable bias voltage source 32 to ground for the purpose of adjusting the concentration of the reversed picture image.

In the embodiment shown in FIG. 4, in the case of producing a copy of the picture image which is positive to the optical image, the step of transferring charge from the chargeable drum 23 is not effected. For this purpose, the chargeable drum 23 may mechanically be separated from the photosensitive record sheet 19. Alternatively, the surface potential of the chargeable drum 23 may be made 0 V. In this case, it is necessary to not only stop the flow of corona ions directed to the chargeable drum 23, but also to eliminate the residual charge remaining on the chargeable drum 23. That is, there is a risk of the charge having the positive polarity remaining for a long time on the chargeable drum 23, this charge having the positive polarity being produced in the case of obtaining the copy of the picture image which is negative to the optical image.

In order to effectively eliminate the residual charge, the potential on the grid 28 arranged between the chargeable drum 23 and the alternating current corona discharge device 29 is made 0 V by connecting a contact arm of the change-over switch 31 to the ground contact and then the alternating current corona discharge device 29 is operated to direct the flow of alternating current corona ions toward the chargeable drum 23. In this case, it is preferable not to supply a corona voltage to the corona discharge device 27 which functions to charge the chargeable drum 23 with the flow of corona ions having the positive polarity.

In the embodiment shown in FIG. 4, the electrostatic latent image which is positive to the optical image is produced by the negative charge and the electrostatic latent image which is negative to the optical image is produced by the positive charge.

In order to produce on the photosensitive record sheet 19 the electrostatic latent image which is positive and negative in the same electrographic apparatus, it is preferable to use one ingredient magnetic toner as the toner used in the developing device 25. If use is made of a developing liquid or a polarized toner such as a two ingredient toner particles, both the negative image and the positive image are required to be the electrostatic latent images which are the same in polarity. For this purpose, the polarity of the flow of corona ions for uniformly charging the photosensitive record sheet 19 may be changed over from positive to negative and vice versa.

In the embodiment shown in FIG. 4, the corona discharge device 21 is interlocked with a corona electric source 33 by means of a polarity change-over switch 35 and the corona discharge device 22 is interlocked with a corona electric source 34 by means of a polarity change-over switch 36. That is, in the case of producing a copy of a picture image which is negative with respect to the optical image, the photosensitive record sheet 19 is uniformly charged with the flow of corona ions having the negative polarity to produce thereon an electrostatic latent image caused by the negative charge which is positive with respect to the optical image and then the photosensitive record sheet 19 is brought into contact with the chargeable drum 23 charged with the flow of corona ions having the positive polarity to produce on the photosensitive record sheet 19 the electrostatic latent image charged with the flow of corona ions having the positive polarity and negative with respect to the optical image.

On the contrary, in the case of obtaining a copy of the picture image which is positive with respect to the optical image, the polarity of the flow of corona ions directed from the corona discharge devices 21 and 22 is reversed by means of the polarity change-over switches 35 and 36, respectively. As a result, on the photosensitive record sheet 19 is produced an electrostatic latent image caused by the positive charge which is positive with respect to the optical image, but the step of transferring the charge from the chargeable drum 23 to the photosensitive record sheet 19 is not effected. In this case, the development may be effected by the developing liquid, polarized toner such as two ingredient toner particles or non-polarized toner such as one ingredient magnetic toner. Use may be made of a zinc oxide coated paper or the like as the above mentioned photosensitive body which can be charged with positive and negative polarities and has substantially the same photosensitivity with respect to the charge having the positive and negative polarities. As stated hereinbefore, the invention is capable of simply producing, on a latent image holding member produced thereon with an electrostatic latent image, an electrostatic latent image composed of charge which is negative to said electrostatic latent image and which has an opposite polarity by bringing a chargeable member uniformly charged with a charge having a polarity which is opposite to the charge for producing said electrostatic latent image into contact with and separating from said latent image holding member. As a result, if the invention is applied to a microfilm printer, use may be made of the same electrographic apparatus so as to obtain a positive picture image with respect to a negative picture image of the microfilm. In addition, the invention is capable of using the same electrographic apparatus for the purpose of obtaining a negative picture image and a positive picture image by a simple operation of selectively making the surface potential of the chargeable member substantially 0 V or of separating the chargeable member from the latent image holding member.

In addition, the invention is capable of using a non-polarized developing agent such as one ingredient magnetic toner or the like for the purpose of obtaining a reversed picture image. Alternatively, the invention makes it possible to use a developing liquid or polarized developing agent such as two ingredient developing powders by suitably selecting the polarity of the charge of the electrostatic latent image produced on the latent image holding member.

The invention is not limited to the above mentioned embodiments and many changes and modifications may be made. For example, in the embodiment shown in FIG. 4, use was made of the roll-shaped photosensitive record sheet 19. Instead of such roll-shaped photosensitive record sheet, use may be made of a photosensitive plate or photosensitive drum for use in Xerox process or a screen photosensitive body for use in a screen process of controlling a flow of corona ions. In the case of using the above mentioned photosensitive plate or photosensitive drum, an electrostatic latent image which is positive with respect to the optical image is produced therein and then the chargeable member is brought into contact therewith to reverse the above mentioned electrostatic latent image into an electrostatic latent image which is negative with respect to the optical image in the manner as described above and which is then developed and transferred onto the record member. In the case of using the above mentioned screen photosensitive body, a flow of corona ions is modulated by an electrostatic latent image produced thereon and positive with respect to the optical image formed thereon to produce on an dielectric record member a copy of a latent image. Then, the chargeable member is brought into contact with the dielectric record member to reverse the electrostatic latent image which is positive with respect to the optical image to an electrostatic latent image which is negative with respect to the optical image and the electrostatic latent image thus reversed is developed.

In the above described embodiment, the chargeable drum was used as the chargeable member. Such chargeable drum may be replaced by a belt-shaped or sheet-shaped chargeable member.

In the embodiment shown in FIG. 4, the chargeable drum 23 was connected through the variable bias voltage source 32 to ground. The variable bias voltage source 32 may eventually be connected to the grounded roller 24 with an opposite polarity.

In addition, in the above embodiments, the charge at the imagewise dark area of the photosensitive body 1 or photosensitive record sheet 19 should preferably be eliminated to zero by the chargeable drum 6 or 23. Alternatively, if use is made of a developing device having a high threshold developing value, the charge of the imagewise dark area of the photosensitive body 1 or the photosensitive record sheet 19 may be made a potential other than 0 V.

What is claimed is:

1. In an improved electrographic apparatus comprising a charge holding means, means for producing, on said charge holding means, an electrostatic latent image having a negative polarity, a chargeable drum composed of an electrically conductive member and a dielectric layer coated thereon, means for uniformly charging said chargeable drum, and means for bringing the thus uniformly charged chargeable drum into contact with said charge holding means which has said electrostatic latent image produced thereon and for moving said charge holding means, wherein the improvement comprises: said means for uniformly charging said chargeable drum comprises a direct current corona discharge device for charging said chargeable drum with a positive polarity, an alternating current corona discharge device including a grip disposed between said alternating current corona discharge device and said chargeable drum being supplied with a bias voltage having a positive polarity and in which said charge holding means is brought into contact with the chargeable drum of a previously uniformly charged opposite polarity, to thereby eliminate the electrostatic latent image having a negative polarity and to cause the charge having the positive polarity to remain at that region of said charge holding means on which said electrostatic latent image having a negative polarity has been deleted by exposed light.

2. The apparatus according to claim 1, comprising: further means for changing over the bias voltage and being further operative to apply to said grid of the alternating current corona discharge device, a potential which is the same as that of an electrically conductive member of said charge holding means, said alternating current corona discharge device being operative to maintain the charge potential of said chargeable drum at said potential of said electrically conductive member of said charge holding means.

* * * * *